US005406531A

United States Patent [19]

Henriquez et al.

[11] Patent Number: 5,406,531

[45] Date of Patent: Apr. 11, 1995

[54] LOW FREQUENCY FLEX-BEAM UNDERWATER ACOUSTIC TRANSDUCER

[75] Inventors: Theodore A. Henriquez; Clementina M. Siders; Allan C. Tims, all of Orlando, Fla.

[73] Assignee: The United States of America as represented by the Secretary of the Navy, Washington, D.C.

[21] Appl. No.: 54,485

[22] Filed: Apr. 30, 1993

[51] Int. Cl.[6] ..... H04R 17/00

[52] U.S. Cl. ..... 367/157; 367/160; 367/162; 367/159; 310/322; 310/330; 310/337

[58] Field of Search ..... 367/157, 159, 160, 162, 367/161; 310/322, 330, 337

[56] References Cited

U.S. PATENT DOCUMENTS

| | | | |
|---|---|---|---|
| 2,384,465 | 9/1945 | Harrison | 177/386 |
| 3,187,300 | 6/1965 | Brate | 340/10 |
| 3,603,921 | 9/1971 | Dreisbach | 367/160 |
| 4,287,582 | 9/1981 | Tocquet | 367/163 |
| 4,595,338 | 6/1986 | Kolm et al. | 416/81 |
| 4,649,525 | 3/1987 | Angona et al. | 367/31 |
| 4,991,152 | 2/1991 | Letiche | 367/158 |
| 5,068,567 | 11/1991 | Jones | 310/332 |
| 5,099,461 | 3/1992 | Fitzgerald | 367/160 |

OTHER PUBLICATIONS

C. M. Siders et al., "Low-Frequency Underwater Flex--Beam Transducer", NRL Memorandum Report 6962 (30 Jul. 1992).

C. M. Siders et al., "Development of a Unique Compact Low-Frequency Acoustic Source", Proceedings of the 3d International Workshop on Transducers for Sonics & Ultrasonics pp. 222-230 (1992).

*Primary Examiner*—J. Woodrow Eldred

*Attorney, Agent, or Firm*—Thomas E. McDonnell; John J. Karasek

[57] ABSTRACT

A low frequency flex-beam underwater acoustic transducer has a base, a flexible beam having one end cantilever mounted on the base, and piezoelectric driving means, for flexurally driving the beam. The piezoelectric driving means operates in the $k_{31}$ and/or the $k_{33}$ mode.

17 Claims, 7 Drawing Sheets

LOW FREQUENCY FLEX-BEAM UNDERWATER ACOUSTIC TRANSDUCER

BACKGROUND OF THE INVENTION

1. Field of the Invention

This invention relates to a compact, lightweight device to produce high-power acoustic signals of relatively low frequencies in water.

2. Description of the Related Art

Acoustic devices used to produce high-power, low-frequency sound in the ocean are characterized by their large size and weight. It is desired to be able to generate hundreds of watts of omnidirectional acoustic power at frequencies below 1000 Hz with a device that can be deployed from an aircraft, surface vessel, or submarine. Although conventional low-frequency sources can usually operate over a broad band of frequencies, there exists a definite desire for a compact device with more limited bandwidth which could be assembled in modular configurations of units with different frequencies to meet frequency spectrum requirements.

In order to create high-power acoustic tones in water at low frequencies (below 1000 Hz), a device must produce large volume displacements. The volume displacement is the integral of the normal displacement of a radiating area, taken over that area. Therefore, an acoustic source must either have a large radiating area, a large displacement, or a combination of both.

In order to be effective for such applications as anti-submarine warfare and undersea geological surveying, a transducer must be operable at a wide variety of ocean depths, including great depths of several thousand feet. It is also desired to have such a transducer with an output that varies linearly with the transducer input.

SUMMARY OF THE INVENTION

Accordingly, it is an object of this invention to make a small, light-weight acoustic transducer with a high-power, low frequency, omnidirectional, linear output, for operation at submarine operational depths.

These and additional objects of the invention are accomplished by the structures and processes hereinafter described.

A low frequency flex-beam underwater acoustic transducer has a base, a flexible beam having one end cantilever mounted on the base, and piezoelectric driving means, for flexurally driving the beam.

BRIEF DESCRIPTION OF THE DRAWINGS

A more complete appreciation of the invention will be readily obtained by reference to the following Description of the Preferred Embodiments and the accompanying drawings in which like numerals in different figures represent the same structures or elements, wherein.

DESCRIPTION OF THE PREFERRED EMBODIMENTS OF THE INVENTION

Details of the invention are disclosed in the memorandum report of the Naval Research Laboratory entitled "Low-Frequency Underwater Flex-Beam Transducer" by C. M. Siders, P. J. Klippel, and T. A. Henriquez (NRL Memorandum Report 6962, published 30 Jul. 1992), and in the article entitled "Development of a Unique Compact Low-Frequency Acoustic Source" by C. M. Siders, P. J. Klippel, and T. A. Henriquez, in Proceedings of the Third International Workshop on Transducers for Sonics and Ultrasonics pp. 222–30 (1992), both of which are incorporated, in their entireties, by reference herein.

It has been discovered that the flexurally excited fixed-free beam acoustic transducer of the invention has a uniquely high volume displacement for a transducer of a given size. Consequently, the transducer of the invention has a higher power output than any other known transducer of equivalent size (radiating area) in the low frequency ($\approx$100 Hz to $\approx$1000 Hz) range.

Figure 1:
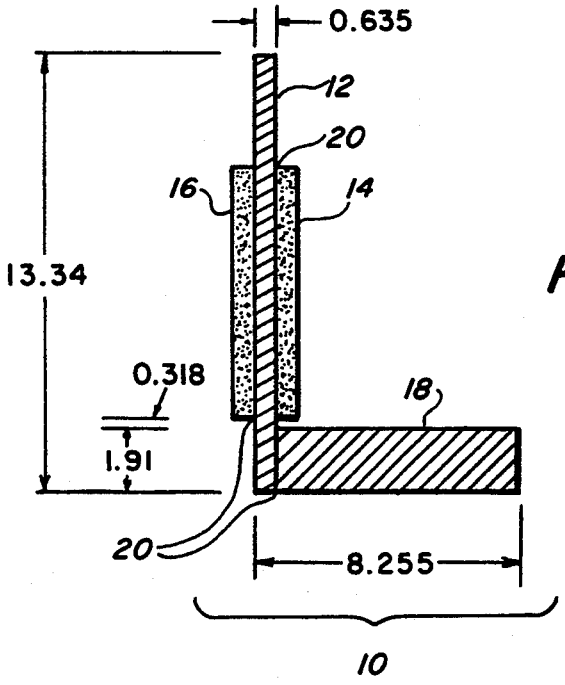
FIG. 1 is a cross-sectional view of a transducer according to the invention.

FIG. 1 shows a transducer 10 with a single flexurally excited fixed-free beam 12 mounted on a base 18 according to the invention (a single paddle "L-shaped" transducer). In this embodiment of the invention, the piezoelectric driving means is a pair of piezoelectric plates 14,16 on opposing sides of the beam 12. Preferably, the base 18, and the piezoelectric plates 14,16 are connected to the beam 12 by epoxy joints 20, although other connecting means may be employed.

The beam may be of any suitable material that will produce the desired combined parameters to attain the desired operating frequency and acoustic level. Preferably, the beam and the base are metal. Preferred metals for the beam and base include steel, aluminum, and titanium. Preferably, the dimensions of the base are selected to provide an effective inertial mass.

The piezoelectric plates 14,16 are suitable for operation in the $k_{31}$ mode. The piezoelectric plates are thickness poled and are used in the transverse mode of operation: the plates are driven so that one plate is increasing in length on one side of the beam while the opposite piezoelectric plate is driven so that it is contracting in length (the plates have opposing polarity). The combined drive of opposing piezoelectric plates produces a bending moment in the beam. The piezoelectric plate dimensions are chosen to fit within the overall geometry constraints of the transducer. The piezoelectric ceramic thickness is chosen to accommodate the necessary high voltage. For PZT-4 (Navy Type 2, Mil. Spec.

1376), the maximum safe electric field is believed to be about 1 kV per 0.254 cm of ceramic thickness in the poling direction. For a typical design having a ceramic thickness of about 0.25 inches, PZT-4 would allow a 2500 V continuous drive.

Preferably, the beam is sandwiched between two shorter piezoelectric plates. Piezoelectric plates having lengths of between about 50% and about 70% of the beam length are capable of efficiently driving the beam to produce a desired bending moment. The optimum plate length is about 60% of the beam length: additional ceramic does not add significantly to the bending moment, and tends to lower the overall efficiency by adding inactive mass to the transducer. See R. S. Woollett, "The Flexural Bar Transducer", Naval Underwater Systems Center, New London, Conn. p. 173 (1987).

Preferably, for a transducer operating at about 500 Hz, the base 18 is not more than about 9 cm long in the direction perpendicular to the beam 12, not more than about 8 cm wide in the direction parallel to the bottom edge of the beam, and not more than about 2 cm thick. Preferably, the beam is not more than about 16 cm long, not more than about 8 cm wide, and not more than about 0.7 cm thick.

Figure 2:
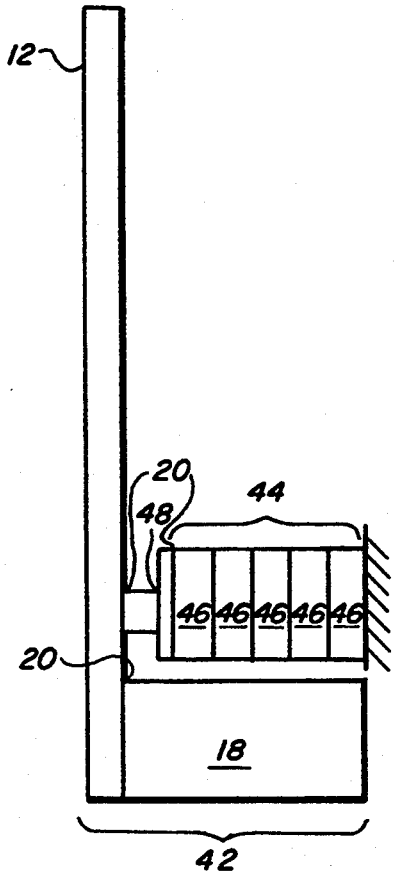
FIG. 2 is a cross-sectional view of another transducer according to the invention.
Figure 3A:
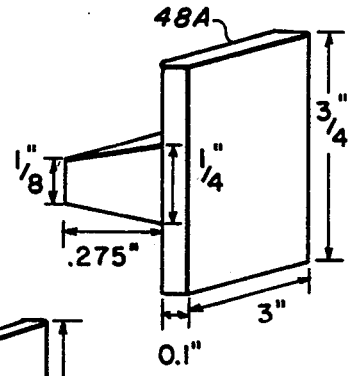
FIG. 3 shows a set of alternative piezoelectric stack attachments.
Figure 3B:
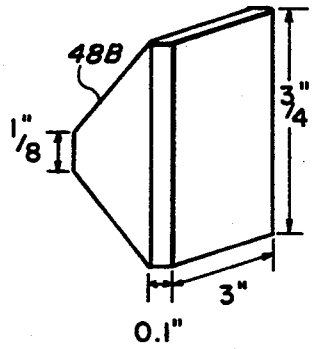
Figure 3C:
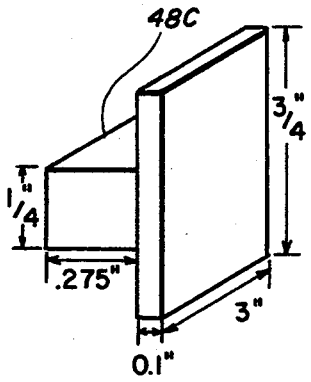

FIG. 2 shows another transducer 42 with a single flexurally excited fixed-free beam 12 mounted on a base 18 according to the invention. In this embodiment of the invention, the piezoelectric driving means is a stack 44 of piezoelectric elements 46 on one side of the beam 12. The stack is coupled to the beam through a stack attachment 48. Several alternative stack attachments are shown in FIG. 3.

The piezoelectric elements in the stack are suitable for operation in the $k_{33}$ mode. The piezoelectric elements are thickness poled and are used in the $k_{33}$ mode of operation: the elements are driven so that they increase in thickness together (the elements have the same polarity). The side of the stack opposite the beam will be braced against another beam, an extension of the base, or some other bracing structure. As the piezoelectric elements expand, the stack drives the beam outward to provide the acoustic signal. This configuration has the advantage of enhancing the linearity of the output with respect to the voltage drive level, i.e. the transducer input.

Figure 4:
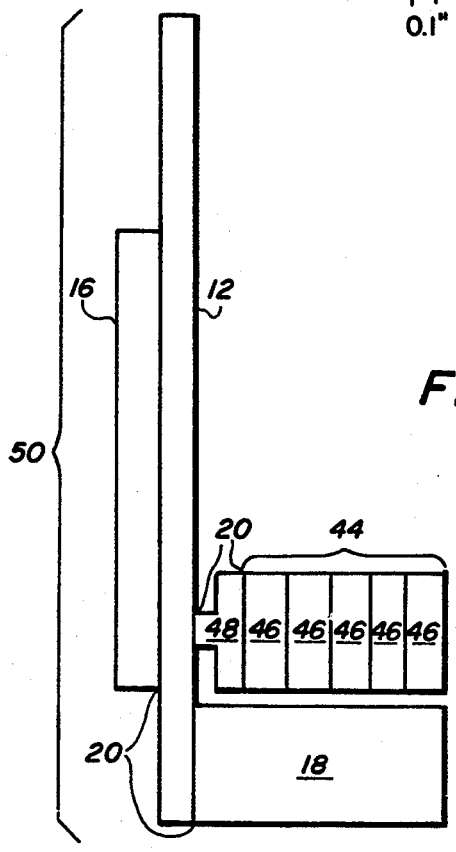
FIG. 4 shows a partial cross-sectional view of a hybrid transducer according to the invention.

FIG. 4 shows a hybrid of the transducers shown in FIGS. 1 and 2. This transducer 50 has a single flexurally excited fixed-free beam 12 mounted on a base 18 according to the invention. In this embodiment of the invention, the piezoelectric driving means is both a piezoelectric plate 16 operating in the $k_{31}$ mode and a stack 44 of piezoelectric elements 46 operating in the $k_{33}$ mode, on opposing sides of the beam 18. This transducer also has enhanced linearity relative to the piezo-beam-piezo laminate transducer shown in FIG. 1.

Figure 5:
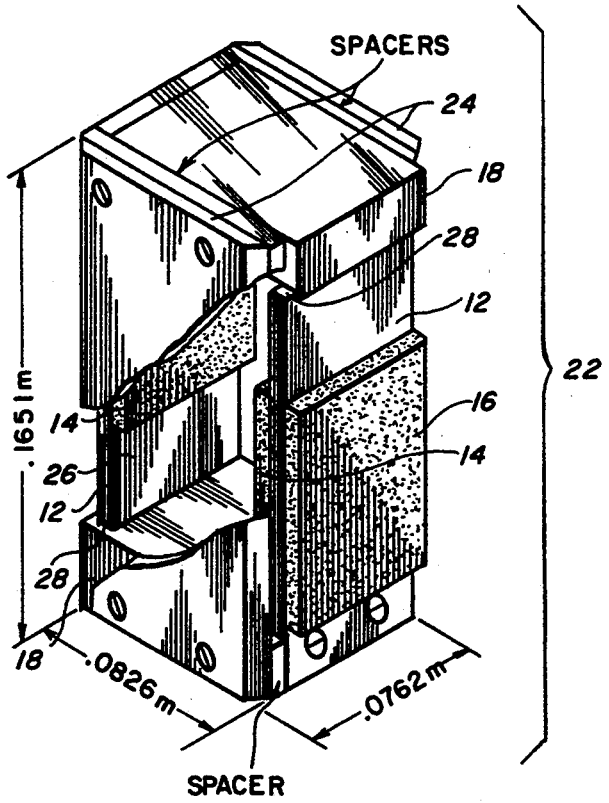
FIG. 5 is a partial cutaway view of a transducer array according to the invention.

FIG. 5 shows a transducer array 22 with two "L-shaped" flexurally excited fixed-free beams 12 mounted on separate, opposing bases 18 (a two paddle array). Again, the piezoelectric driving means are pairs of piezoelectric plates 14,16 on opposing sides of the beams 12. This nearly closed configuration minimizes the acoustic shunting from the outer surfaces to the inner areas. This minimization of aacoustic shunting avoids self-cancellation of the output acoustic signal. The two side plates 24 provide mechanical support for the paddle assembly, as well as acting as baffles to block the acoustic path from the exterior to the interior 26 of the assembly. Fine tuning of the two paddle array can be performed by optimizing the spacing 28 between the paddle assemblies to allow maximum acoustic baffling with minimum viscous losses. Smaller spacing increases the amount of acoustic energy radiated but also increases losses due to the viscosity of the fill fluid.

Figure 6:
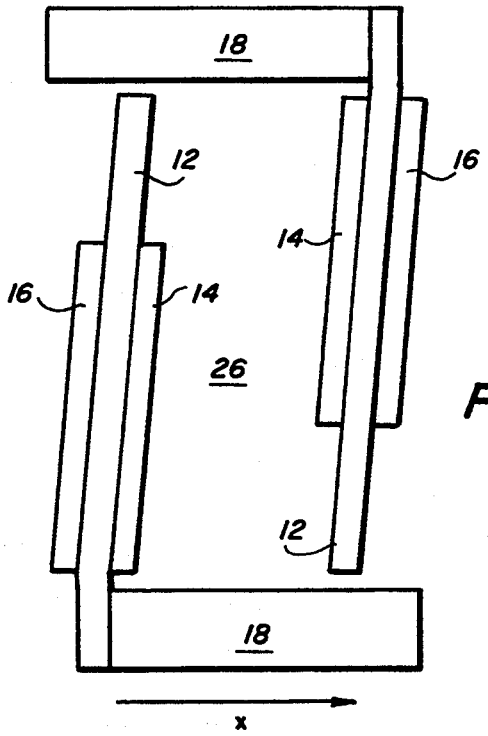
FIG. 6 is a schematic view of a transducer array according to the invention, where the elements of the array are driven out of phase.

In operation, a two paddle array typically will be driven in an out-of-phase mode, as shown in FIG. 6. Out of phase means that as one paddle of the array reaches its maximum deflection in the positive x direction, the opposing paddle reaches its maximum deflection in the negative x direction, i.e. the paddles reach their maximum outward deflection together.

Figure 7:
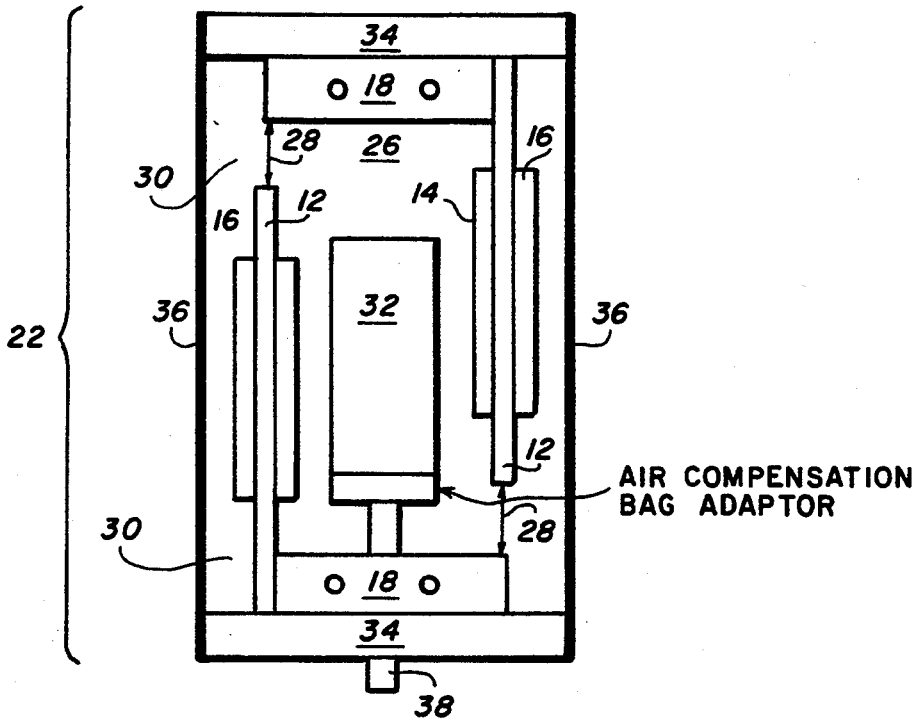
FIG. 7 is a cross-sectional view of a transducer array with an internal air bladder.

FIG. 7 shows in cross-section the same array as in FIG. 5, with some additional elements. The assembly preferably is protected from the ambient water by an elastomeric thin-walled cylinder 36, and by a pair of endcaps 34 outside of the bases 18. The internal cavity 26 is filled with a dielectric fluid 30, preferably with close matching of acoustic impedance with the ambient water (close $\rho$.c matching). Preferably, $\rho$.c of the fill fluid is within about $\pm 15\%$ of $\rho$.c for the ambient water. Preferred fill fluids include castor oil and Fluorinert (FC-43).

The acoustic output is developed by the reactance of the water on the vibrating beams. The fixed-free beam provides a primary mode of vibration for this configuration lower in frequency than any other applicable system. The acoustic energy is transmitted to the water through the dielectric fluid.

Since the fluid-backed beams are mechanically stiffened by a closed fluid system, a soft or very low acoustic impedance surface 32 is preferably provided on the side of the beams 12 opposite to the radiating area. To reduce this stiffness, a compliant elastomeric air bladder 32 is preferably positioned in the cavity 26 between the two paddles to provide a pressure release surface, thereby increasing the compliance of the internal cavity 26. This bladder 32 will typically be pressurized to be in equilibrium with the ambient water pressure. Preferably, an air valve 38 is connected to the bladder 32 to provide means for controlling the inflation of this bladder 32, thereby providing a way to operate at varying water depths.

Figure 8:
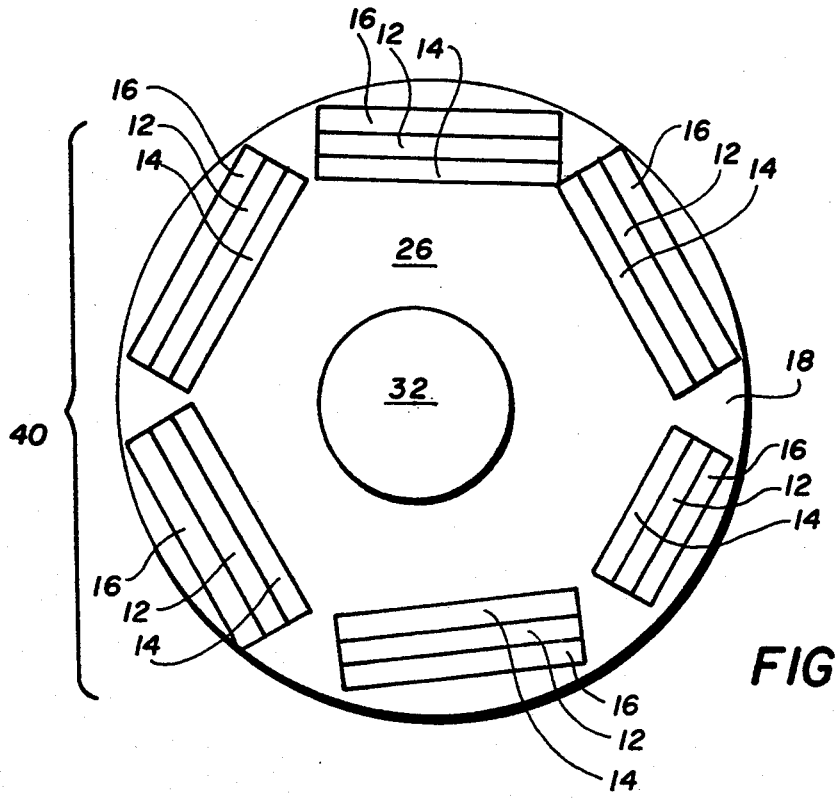
FIG. 8 shows a preferred array with multiple transducers according to the invention.

FIG. 8 shows a top sectional view of another preferred array 40 according to the invention. In this array 40, there are n flexible beams 12 with their associated piezoelectric drivers 14,16 mounted on and arranged about a common base 18, where n is an integer between 2 and about 20, inclusive. In the case where n is 3 or more, these beams 12 preferably will be arranged peripherally about the common base 18 roughly in the shape of an n-gon. This configuration, which is analogous to the barrel stave configuration, provides advantageous distribution of the acoustic energy.

Figure 9:
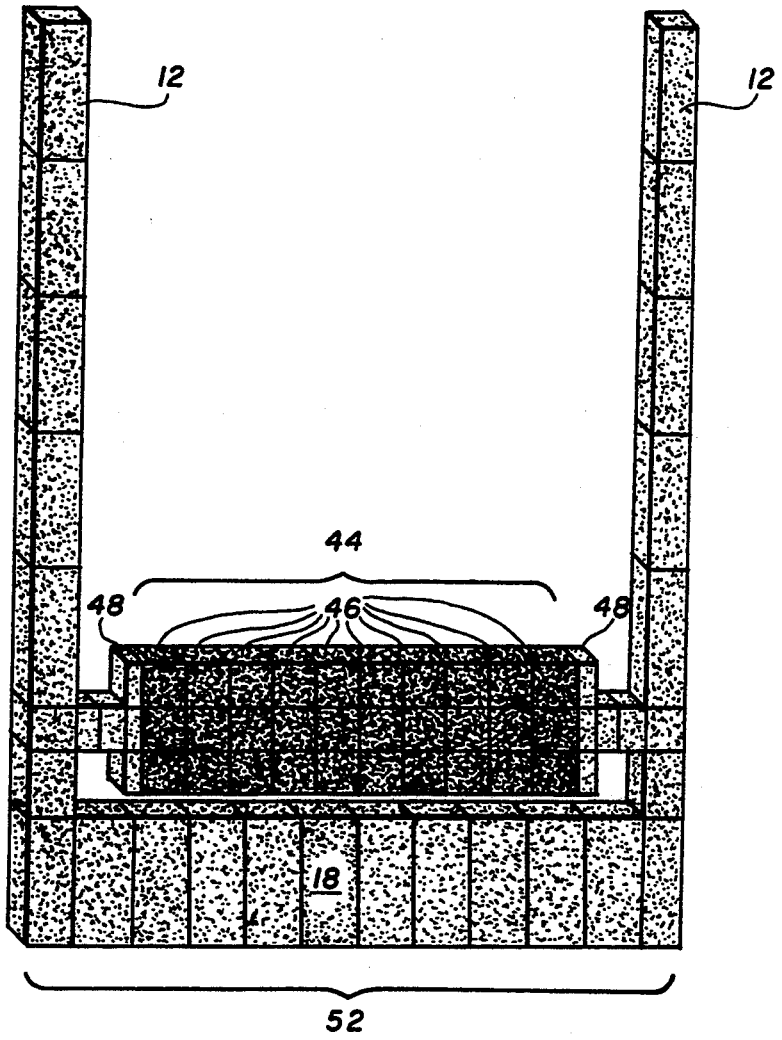
FIG. 9 shows a preferred U-shaped array according to the invention.

Another preferred array is the "U-shaped" transducer array. In the U-shaped transducer array, there are 2 flexurally excited fixed-free beams 12 on opposing sides of a common base 18. These beams may be driven in the $k_{31}$ mode, in the $k_{33}$ mode, or in the $k_{31}/k_{33}$ hybrid mode. FIG. 9 shows such a U-shaped array 52, driven by a stack 44 in the $k_{33}$ mode.

Figure 10:
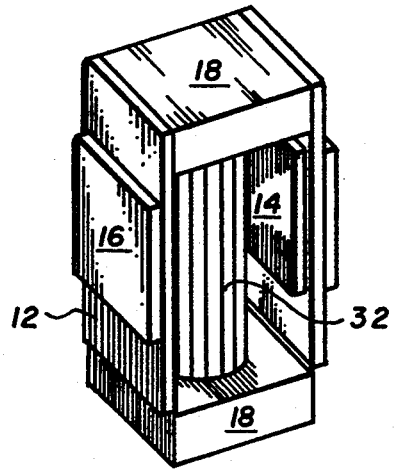
FIG. 10 shows a preferred double-U array according to the invention.

Many geometrical configurations are possible using the basic flex-beam component. As an example, an array of basic paddle assemblies may be arranged in a circular configuration so as to provide increased sound levels, at the expense of increased system size. Also, the basic elements may be arranged in a linear array for increased output and to give horizontal spatial directivity. Another alternative is a four-paddle configuration shown in FIG. 10. This configuration comprises two U-shaped arrays interlocked to form an array with four radiating surfaces. Another alternative configuration would be a Helmhotz resonator, made by providing an acoustic port to resonate with the enclosed fluid volume. This would eliminate the need for an internal pressure compensation system. Arrays according to the invention could be tuned to have a broad bandwidth by tuning each transducer in the array to resonate at a different frequency.

Having described the invention, the following examples are given to illustrate specific applications of the invention, including the best mode now known to perform the invention. These specific examples are not intended to limit the scope of the invention described in this application. Unless otherwise noted, piezoelectric ceramic parts were made from PZT-4, and parts are joined with epoxy resin. Unless otherwise noted, the bases were stainless steel and measured 6.5" long×3" wide×0.75" high. Unless otherwise noted, the beams were stainless steel and measured 5.25" high×3" wide×0.25" thick.

EXAMPLES

EXAMPLE 1

Figure 11:
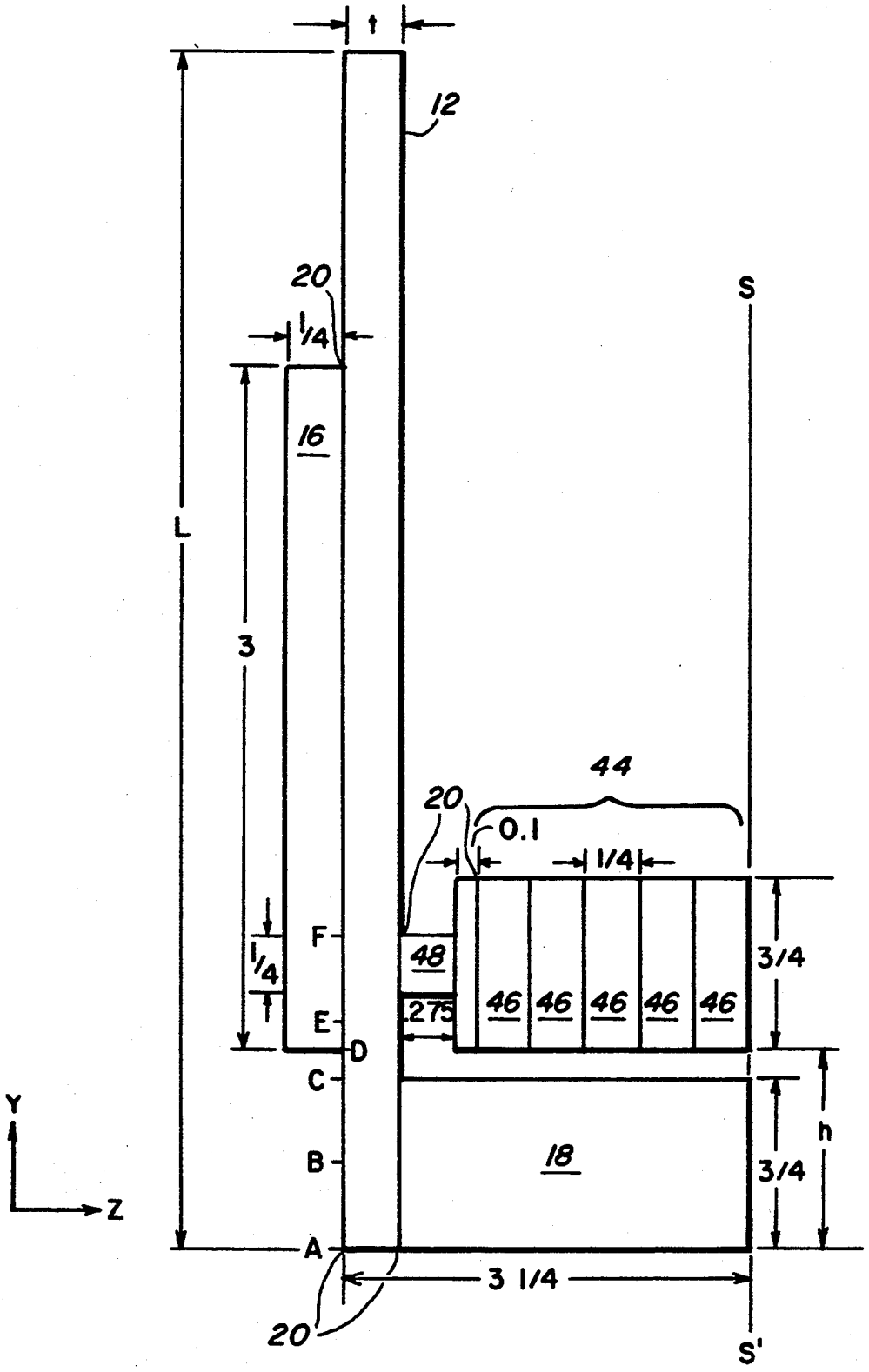
FIG. 11 shows a cross-sectional view of half of a hydrid transducer array according to the invention.

Preparation of a set of U-shaped transducer arrays with varying beam thicknesses FIG. 11 shows a cross-section of half of a U-shaped transducer array. Line S—S' lies on a symmetry plane. A series of these arrays were made, with the piezoelectric plate 16 omitted, and with varying thicknesses for the steel beams. The piezoelectric stacks were made up of 10 PZT-4 plates measuring 0.75"×3"×0.25". The ends of the stacks were connected to the beams by stack connectors that were 0.375" long, with widths ranging from 0.25" at their narrowest to 0.75" at their widest. The beams were 5.25" high×3" wide, and had thicknesses ranging from 0.125" to 0.5". The resonant frequency ($F_r$) and antiresonant frequency ($F_a$) of each of these transducers are given in Table 1.

TABLE 1

| Varying Steel Beam Thickness | | |
|---|---|---|
| t (inches) | $F_r$ (Hz) | $F_a$ (Hz) |
| ⅛ | 261.7 | 261.8 |
| 3/16 | 390 | 391 |
| ¼ | 499 | 501 |
| ½ | 840 | 855 |

EXAMPLE 2

Preparation of a set of U-shaped transducer arrays with varying ceramic plate positions FIG. 11 shows a cross-section of half of a U-shaped transducer array. Line S—S' lies on a symmetry plane. A series of these arrays were made, with varying positions for the piezoelectric ceramic plates. The piezoelectric stacks and stack connectors had the same dimensions as in Example 1. The piezoelectric plates were 3" long×3" wide×0.25" thick, and were positioned at locations ranging from even with the bottom of the bases (position A) to 1.375" above the bottom of the base (position E). The resonant and antiresonant frequencies of each of these transducers are given in Table 2.

TABLE 2

| Varying Piezoelectric Ceramic Plate Location | | | |
|---|---|---|---|
| Point | Location referenced to A | $F_r$ (Hz) | $F_a$ (Hz) |
| A | 0" | 781 | 801 |
| B | ⅜" | 800 | 826 |
| C | ¾" | 781 | 808 |
| D | 7/8" | 754 | 779 |
| E | 1" | 719 | 741 |
| F | 1⅜" | 618 | 629 |

EXAMPLE 3

Preparation of a set of U-shaped transducer arrays with varying steel beam lengths FIG. 11 shows a cross-section of half of a U-shaped transducer array. Line S—S' lies on a symmetry plane. A series of these arrays were made, with varying lengths for the steel beams. The stainless steel bases, piezoelectric stacks, and stack connectors had the same dimensions as in Example 1. The piezoelectric plates were 3" long×3" wide×0.25" thick, and were positioned ⅞" from the bottom of the steel base (position D). The beams were 3" wide ×0.25" thick, and had lengths ranging from 4.75" to 5.25". The resonant and antiresonant frequencies of each of these transducers are given in Table 3.

TABLE 3

| Steel Beam Length | | |
|---|---|---|
| L | $F_r$ (Hz) | $F_a$ (Hz) |
| 4¾" | 913.7 | 945.4 |
| 5" | 893.7 | 925.8 |
| 5¼" | 754.0 | 779.3 |

EXAMPLE 4

Preparation of a set of U-shaped transducer arrays with varying stack attachment fixture configurations A series of arrays identical with the ones in Example 3 were prepared, with a steel beam length of 5.25". A variety of stack attachment fixtures were used to connect the stacks to the beams. FIG. 3 shows these attachments, labelled 48A, 48B, and 48C. The resonant and antiresonant frequencies of each of these transducers are given in Table 4.

TABLE 4

| Stack Attachment Fixtures | | |
|---|---|---|
| Stack attachment fixture | $F_r$ (Hz) | $F_a$ (Hz) |
| 48A | 727 | 752 |
| 48B | 748 | 773 |
| 48C | 754 | 779 |

EXAMPLE 5

Preparation of a set of U-shaped transducer arrays with varying stack placements FIG. 11 shows a cross-section of half of a U-shaped transducer array. Line S—S' lies on a symmetry plane. A series of these arrays were made, with varying placements for the piezoelectric stack. The resonant and antiresonant frequencies of each of these transducers are given in Table 5.

TABLE 5

| h (inches) | Position of stack $F_r$ (Hz) | $F_a$ (Hz) |
|---|---|---|
| 7/8 | 727.6 | 752.6 |
| 1¼ | 897.8 | 921.9 |

EXAMPLE 6

Preparation of a U-shaped transducer array with a shortened piezoelectric stack

FIG. 11 shows a cross-section of half of a U-shaped transducer array . Line S—S' lies on a symmetry plane. This array was made, except that the piezoelectric stack length was shortened to 1.5" and the base length was shortened to 4.5". This array has $F_r$=831 Hz and $F_a$=857 Hz.

EXAMPLE 7

Analysis of the output of a transducer array

Figure 12:
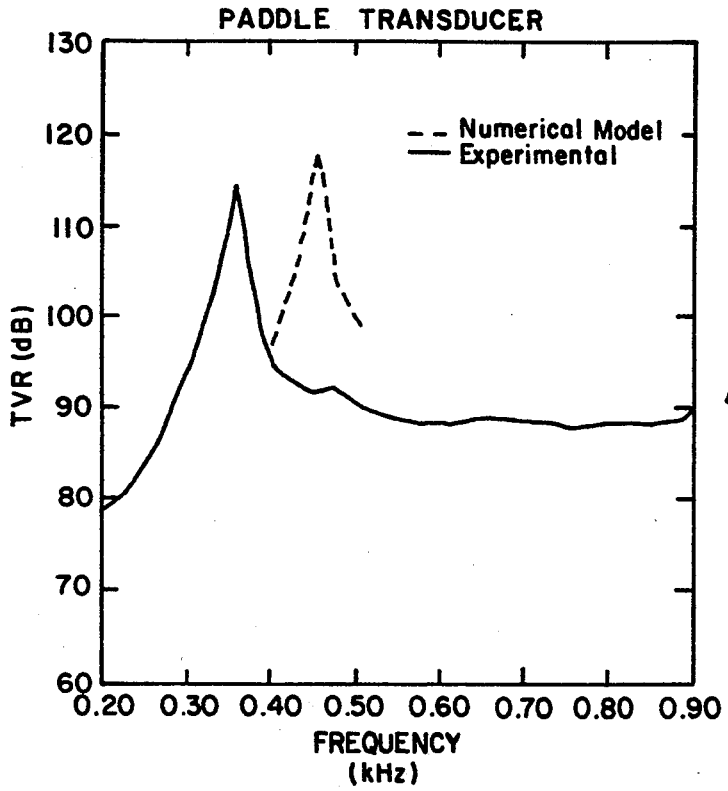
FIG. 12 shows the output spectrum of an array according to the invention.

The transducer array shown in FIG. 5 was assembled. The array was driven with a continous oscillating source. Output frequency intensity was measured between 0.20 kHz and 0.90 kHz; results are shown in FIG. 12. TVR=20·log(pressure in/voltage out).

Figure 13:
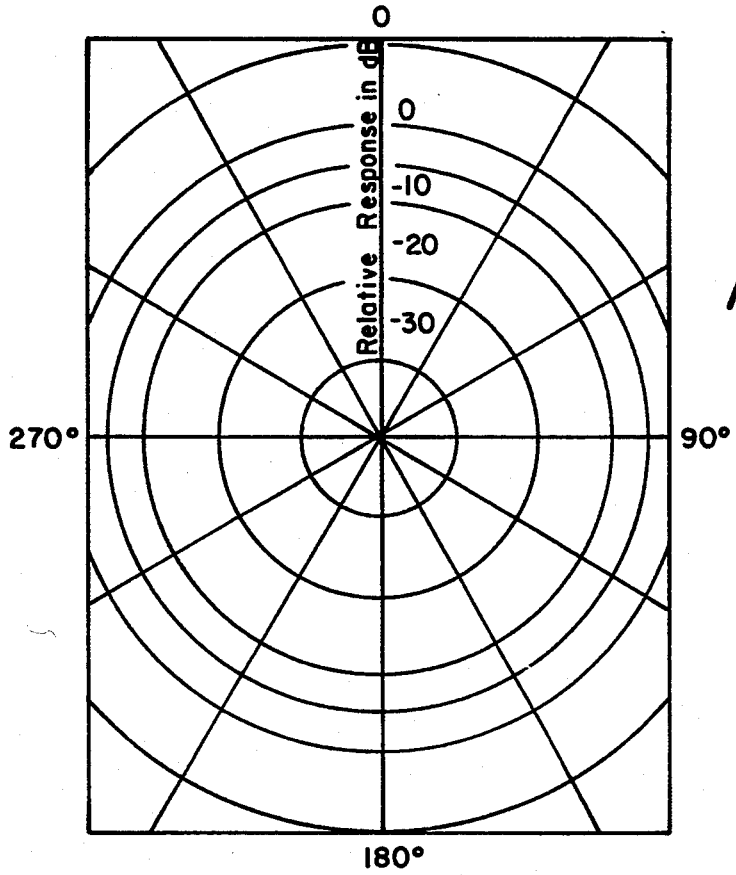
FIG. 13 shows the directional output pattern of a preferred two paddle array according to the invention.

The directivity of this transducer array was measured by measuring the normalized output at varying angles around the transducer array. The output of this transducer array proved to be essentially symmetric. Results are shown in FIG. 13.

Obviously, many modifications and variations of the present invention are possible in light of the above teachings. It is therefore to be understood that, within the scope of the appended claims, the invention may be practiced otherwise than as specifically described.

What is claimed is:

1. A low frequency flex-beam acoustic transducer, comprising:

a first base;

a first flexible beam having a first end, a second end, and two pairs of opposing sides, and having said first end cantilever mounted on said base; and piezoelectric driving means, for flexurally driving said first beam, said piezoelectric driving means including means for driving said first beam in the $K_{33}$ mode.

2. The low frequency flex-beam underwater acoustic transducer of claim 1, wherein said means for driving said beam in the $k_{33}$ mode comprises a stack of piezoelectric elements.

3. The low frequency flex-beam acoustic transducer of claim 1, further comprising:

a second base opposing said first base, said bases disposed essentially parallel to each other;

a second flexible beam having a first end, a second end, and two pairs of opposing sides, said first end being cantilever mounted on said second base, and said second beam directed towards said first base; and wherein said first beam is directed towards said second base; and said piezoelectric driving means flexurally drives said second beam.

4. The low frequency flex-beam acoustic transducer claim 3, wherein said piezoelectric driving means comprises means for driving said beams out of phase with respect to each other.

5. The low frequency flex-beam acoustic transducer of claim 4, wherein said piezoelectric driving means includes a first stack of piezoelectric elements connected to said first beam and a second stack of piezoelectric elements connect to said second beam.

6. The low frequency flex-beam acoustic transducer of claim 4, further comprising:

a first acoustic baffle, having a first end and a second end, wherein said first end of said first acoustic baffle is mounted on said first base, essentially perpendicular to said first base, wherein said second end of said first acoustic baffle is mounted on said second base, essentially perpendicular to said second base, and wherein said first acoustic baffle is essentially perpendicular to said first beam and to said second beam;

a second acoustic baffle, having a first end and a second end, wherein said first end of said second acoustic baffle is mounted on said first base, essentially perpendicular to said first base, wherein said second end of said second acoustic baffle is mounted on said second base, essentially perpendicular to said second base, and wherein said second acoustic baffle is essentially perpendicular to said first beam and to said second beam, wherein said first and second baffles are both essentially perpendicular to said first and second bases, whereby said first base, said second base, said first beam, said second beam, said first acoustic baffle, and said second acoustic baffle define a void.

7. The low frequency flex-beam acoustic transducer of claim 6, further comprising acoustic pressure absorbing means disposed in said void.

8. The low frequency flex-beam acoustic transducer of claim 7, wherein said acoustic pressure absorbing means comprises an elastomeric bladder inflated with a gas.

9. The low frequency flex-beam acoustic transducer of claim 8, further comprising pressure-adjusting means for inflating and deflating said elastomeric bladder.

10. The low frequency flex-beam acoustic transducer of claim 1, wherein said first base has a perimeter; and further comprising a plurality of flexible beams, including said first beam, each having a first end cantilever mounted on said base, disposed about said perimeter of said base; and wherein said piezoelectric driving means flexurally drives each of said beams.

11. The low frequency flex-beam acoustic transducer of claim 10, wherein said piezoelectric driving means comprises means for driving said beams out of phase.

12. The low frequency flex-beam acoustic transducer of claim 10, wherein said piezoelectric driving means includes a plurality of stacks at piezoelectric elements, each stack connected to one of said plurality of flexible beams.

13. The low frequency flex-beam acoustic transducer of claim 1, further comprising:

a second flexible beam having a first end cantilever mounted on said base and being disposed essentially parallel to and opposing said first beam; and wherein said piezoelectric driving means flexurally drives said first and second beams out of phase.

14. The low frequency flex-beam acoustic transducer of claim 13, wherein said piezoelectric means comprises a stack of piezoelectric elements connected between said beams, said stack being disposed essentially perpendicular to said beams.

15. The low frequency flex-beam acoustic transducer of claim 1, wherein said piezoelectric driving means further includes means for driving said first beam in the $K_{31}$ mode.

16. The low frequency flex-beam acoustic transducer of claim 15, wherein said means for driving said first beam in said $K_{33}$ mode includes a stack of piezoelectric elements connected perpendicularly to a first side of said first beam, and said means for driving said first beam in said $K_{31}$ mode includes a piezoelectric plate connected to a second side of said first beam, said piezoelectric plate being parallel to said first beam.

17. The low frequency flex-beam acoustic transducer of claim 1, wherein said first beam is mounted to said base by adhesive.

* * * * *